US005774627A

United States Patent [19]

Jackson

[11] Patent Number: 5,774,627

[45] Date of Patent: Jun. 30, 1998

[54] SCALE REDUCING HEATING ELEMENT FOR WATER HEATERS

[75] Inventor: Barry N. Jackson, Woodbury, Minn.

[73] Assignee: Water Heater Innovation, Inc., Eagan, Minn.

[21] Appl. No.: 594,161

[22] Filed: Jan. 31, 1996

[51] Int. Cl.[6] ..... H05B 3/40

[52] U.S. Cl. ..... 392/497; 392/503; 219/523

[58] Field of Search ..... 392/497, 500, 392/501, 503, 447, 448, 451; 219/520, 523

[56] References Cited

U.S. PATENT DOCUMENTS

| | | | |
|---|---|---|---|
| 2,380,545 | 7/1945 | Pankow | 392/497 |
| 2,533,615 | 12/1950 | Osterheld | 392/497 |
| 2,849,590 | 8/1958 | Stiebel | 392/497 |
| 3,716,693 | 2/1973 | Bleckmann | 392/503 |
| 4,319,127 | 3/1982 | Lindstrom et al. | 392/497 |
| 4,320,702 | 3/1982 | Shein et al. | 392/497 |
| 4,553,024 | 11/1985 | Findlay | 392/503 |

*Primary Examiner*—Tu B. Hoang
*Attorney, Agent, or Firm*—Moore & Hansen

[57] ABSTRACT

An extended life electrical heating element for a water heater includes a coiled heating resistance wire having a uniform power output per coil turn. Where the heating resistance wire passes through the sheath at critical areas, e.g. return bends, the number of coil turns per unit length of element is reduced to reduce thermal power output per unit length of the element. The number of coil turns per unit length of element in bend areas may be reduced by simply stretching the coiled heating wire to attain the desired length of resistance wire per unit length of the element. Resistance wires of differing heat output per unit length may be combined with different degrees of stretching to achieve the desired element temperatures. The reduced power at the bend portions reduces element temperature to reduce hard water scaling and significantly extend the life of the element.

20 Claims, 3 Drawing Sheets

70
72
73
74
76
78
80
82
84
86
88
90
92
94
96
98
100
102
104
106
108
110
112
114
116
118
120
122
124
126

SCALE REDUCING HEATING ELEMENT FOR WATER HEATERS

BACKGROUND OF THE INVENTION

This invention relates generally to electrical water heaters. More particularly, this invention pertains to electric heating elements for water heaters.

Conventional heating elements intended for use in domestic water heaters comprise a one-piece sheath enclosing an electrical resistance wire through which an electrical current is passed. Sheaths of current heating elements are composed of a variety of materials and have many differing shapes and lengths.

Common to nearly all of the conventional heating elements is at least one sharp radius bend. During use, scale composed of calcium sulfate and/or other chemical composition builds up on the exterior surface of the sheath, particularly in hard water applications. The scale acts as an insulator for the sheath, reducing heat transfer from the resistance wire to the water. Over a period of time, the scale buildup may reach a thickness of ¼ inch to an inch or more. As a result, the resistance wire at the return bend may reach temperatures at which the wire material melts or oxidizes and fails.

The scale buildup problem is aggravated at sharp radius bends. There is reduced sheath area for heat transfer in the interior portions of the bend, resulting in generally higher temperatures at the interior bend area than at the exterior bend area. This higher temperature results in greater scale deposition because of the inverse dependence of solubility of e.g. calcium sulfate upon temperature.

In straight sections, the scale typically accumulates equally about the circumference of the sheath. However, due to the proximity of the sheath portions in the "doubled-back" return bend areas, bridging of the scale occurs, effectively doubling the scale thickness and denying access of heat absorbing water to portions of the hot sheath. When a heating element has multiple bends, a number of areas develop at which heating wire failure may occur because of excessively high temperatures resulting from scale accumulation. In fact, such scale buildup is the cause of most element failures.

In the past, efforts to resolve the problem have been centered on using a resistance wire of lower watt density, i.e. lower wattage per unit length. To obtain the equivalent power input, a heating element of greater length and/or diameter must then be used. Installation of a longer element within the limited space of a water heater vessel will require additional bends, compounding the scaling problem.

Even when using a heating element with low power density, resistance wire failure is most likely to occur at a return bend. Reducing the watt density reduces the scale accumulation rate and extends the life of the resistance wire. In some applications, however, the watt density cannot be reduced sufficiently to achieve a reasonable life for the element. This is especially true of small water heater vessels which require high total power levels and have restricted space for increasing the element length.

The use of a longer and/or larger heating element, where possible, results in greater element cost and may require a larger port for inserting and removing the element. Likewise, spreading the element apart to increase the radius of curvature will require a larger port to install the element, greatly increasing the cost of the water heater.

BRIEF SUMMARY OF THE INVENTION

A simple, inexpensive and effective heating element for electric water heaters has been developed which reduces the power density in crucial areas like return bends without reducing the power density in straight sections.

A coiled resistance wire is enclosed within the sheath of an electrical heating element to provide thermal energy which passes through the sheath into the water medium. The resistance wire is configured to have a reduced number of coil turns per unit length of sheath in areas of enhanced chemical scaling, e.g. at return bends and other bends of the element.

The reduced power density reduces the internal sheath temperature and scaling at bends of the element, resulting in (a) more evenly distributed scaling on the surface of the element, (b) an increased overall heat transfer coefficient, (c) more efficient use of input electrical power, (d) increased life of the heating element, and (e) less downtime for replacement or cleaning of the heating element.

In one aspect of the invention, a "wave" heating element with multiple curves of differing radii is equipped with a coiled resistance wire. The coil is stretched longitudinally to different degrees in the varied curves, reducing the element temperature to different degrees depending upon the speed of scale formation in each area.

In another aspect of the invention, the coiled resistance wire may be formed of sections of wire having differing resistance to vary the heat output.

In an optimal configuration, the variation in heat output is set to produce a nearly uniform degree of scaling over the entire sheath surface. Thus, excessively high temperatures at any one location are avoided, and element life is maximized for the given heat transfer area. The rate of scaling is balanced over the total length of the element to prolong the period before bridging first occurs. Early burnout is avoided without significantly affecting the total heat value delivered to the water.

The method and apparatus of varying power density as described herein may be applied to heating elements of a wide variety of shapes and lengths.

DESCRIPTION OF THE PREFERRED EMBODIMENTS

Figure 1:
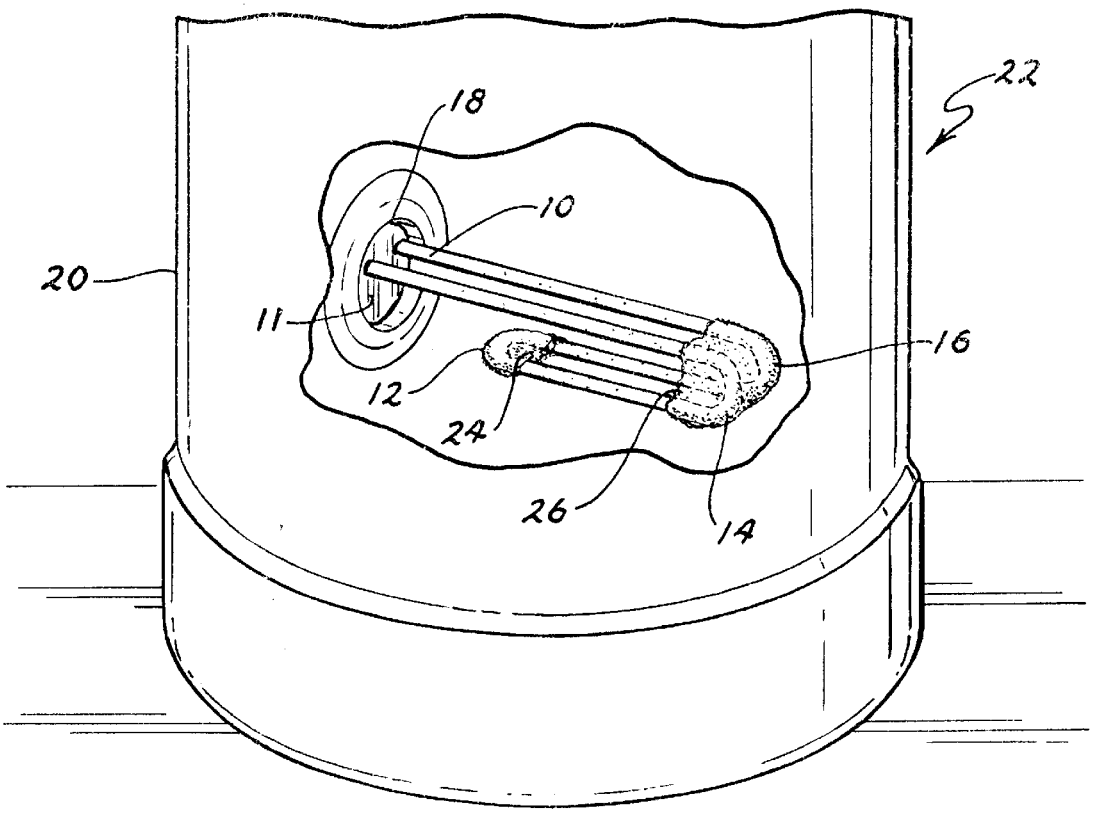
FIG. 1 PRIOR ART
FIG. 1 is a perspective view of a prior art electrical heating element with exemplary scaling in return bend areas.

With reference to the drawings, and particularly to FIG. 1, a typical heating element 10 of the prior art is shown, having three return bends 12, 14 and 16. The heating element 10 is attached to a mount 11 and sealingly passes through a port 18 in the wall 20 of water heater vessel 22. Prior art elements 10 are normally specified by total wattage consumed and an average watt density i.e. watts per unit external area of the element. Typical hard water scale deposits 24 are shown at return bend 12, and scale deposits 26 are shown joining return bends 14 and 16, greatly reducing the quantitative heat transfer in those areas.

Figure 2:
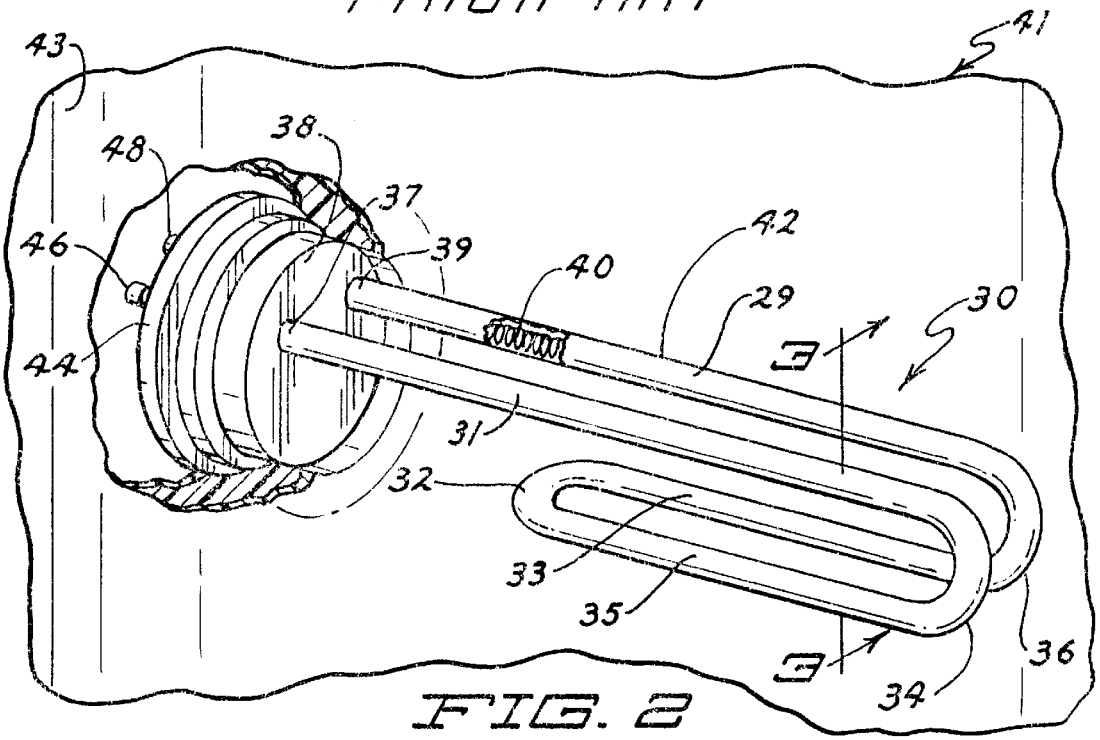
FIG. 2 is a partially cut-away perspective side view of an electrical heating element of the invention.
Figure 3:
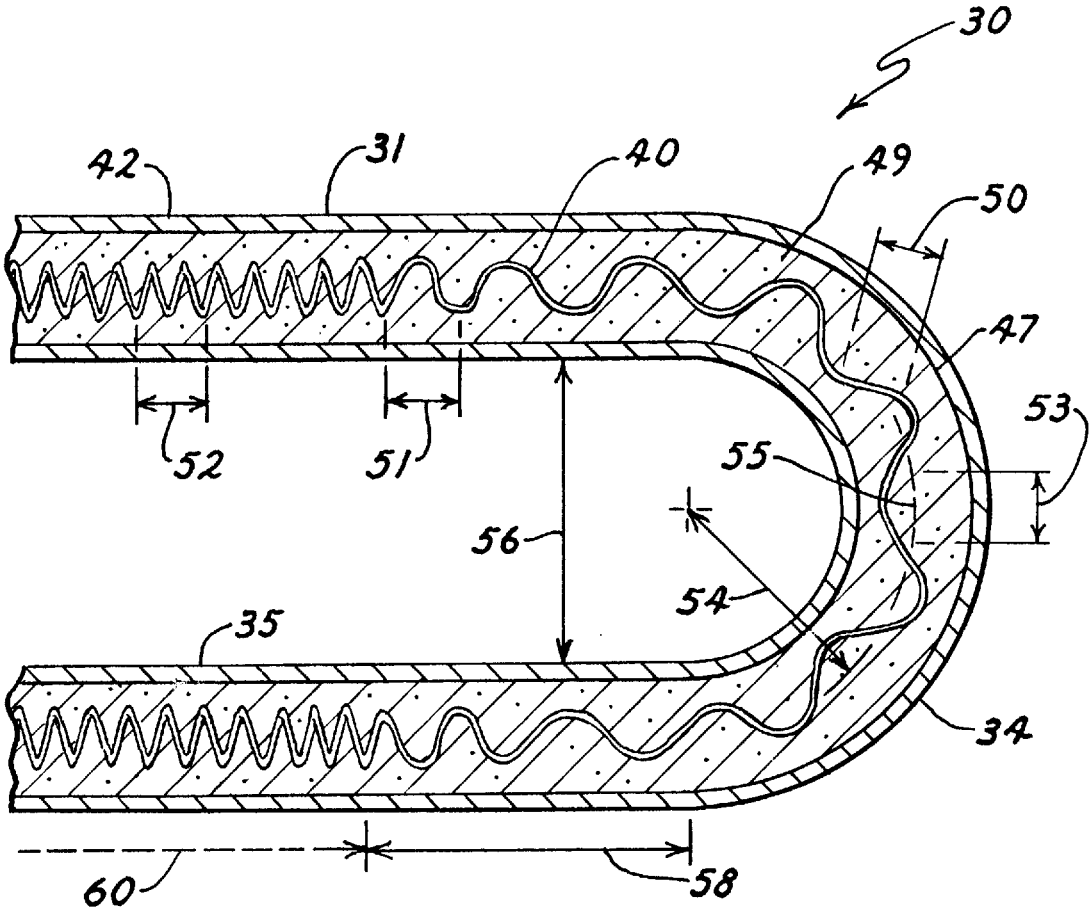
FIG. 3 is a cross-sectional partial side view through an electrical heating element of the invention, as taken along lines 3—3 of FIG. 2.
Figures 4, 4A, 4B, 4C, 4D, 4E, 4F, 4G:
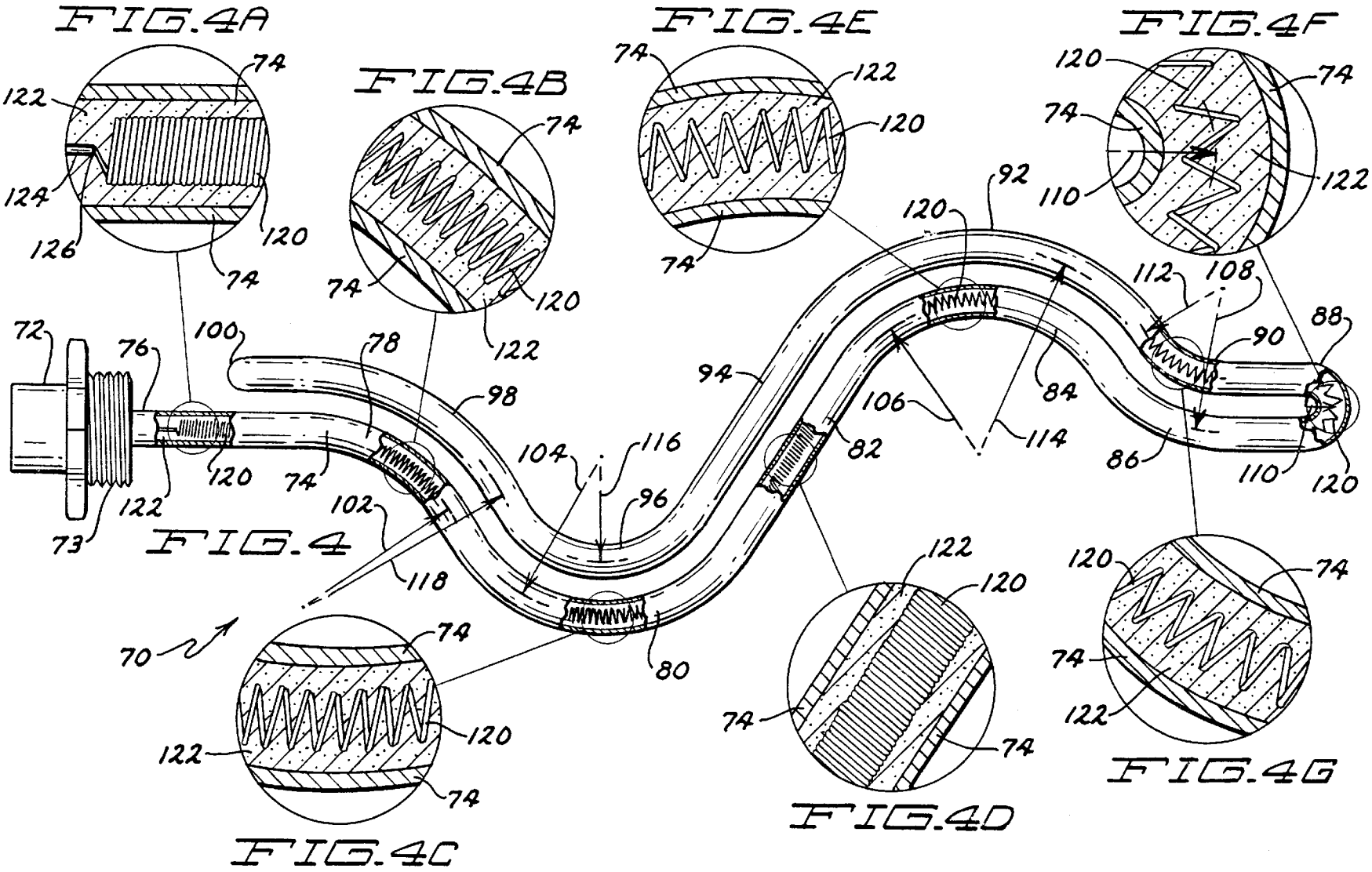
FIG. 4 is a partially cut-away side view of a "wave" type electrical heating element of the invention.
FIG. 4A is an enlarged cut-away side view of an end portion of an electrical heating element of the invention.
FIG. 4B is an enlarged cut-away side view of a first curved portion of a "wave" type electrical heating element of the invention.
FIG. 4C is an enlarged cut-away side view of a second curved portion of a "wave" type electrical heating element of the invention.
FIG. 4D is an enlarged cut-away side view of a straight section of a "wave" type electrical heating element of the invention.
FIG. 4E is an enlarged cut-away side view of a third curved portion of a "wave" type electrical heating element of the invention.
FIG. 4F is an enlarged cut-away side view of a return bend portion of a "wave" type electrical heating element of the invention.
FIG. 4G is an enlarged cut-away side view of a fourth curved portion of a "wave" type electrical heating element of the invention.

The improvement of this invention is depicted in FIGS. 2, 3 and 4. A typical heating element 30 to which this invention is applied is shown in FIG. 2. The element 30 is shown with straight sections 29, 31, 33 and 35, return bends 32, 34 and 36, and ends 37 and 39. The ends 37 and 39 of element 30 are sealingly affixed to an element mount 38 which is configured to be sealingly installed in a port of the pressure vessel, not shown in this view, so that the element 30 is in the interior of the vessel. Other shapes and lengths of the element 30 may be used, provided the element shape and size permit passage of the element 30 through the port.

As indicated in FIGS. 2 and 3, a helically coiled resistance heating wire 40 is enclosed within the hollow external sheath 42 of the element 30. As is known in the art, the resistance wire 40 is connected to electrical terminals 46, 48 on the exterior side 44 of the element mount 38. When installed in a water heater, an external electrical power source, not shown, is connected to the electrical terminals 46, 48 to energize the resistance wire 40 to produce thermal energy. Typically, the interior 47 of the sheath 42 surrounding the heating wire 40 is filled with an electrically insulating, heat conducting material 49 to keep the resistance wire 40 in place and enhance heat transfer. A material 49 such as magnesium oxide powder may be used to surround the resistance wire 40 within the sheath 42. As known in the art, the material 49 may be placed in the sheath around the resistance heating wire 40 and the sheath 42 subsequently rolled to reduce its diameter, thus compressing the material 49 about the resistance wire 40. The sheath 42 is then bent to the final shape including one or more return bends 32, 34, 36.

The heating wire 40 is preconfigured to provide the desired number of coil turns in the coil 41 of wire 40 per unit length in each portion of the sheath 42. In straight sections, the wire 40 may be left unstretched to achieve the maximum power output per unit length or per unit exterior area of the sheath.

The resistance heating wire 40 may have any cross-sectional shape, ranging from circular or oval to square, rectangular or even a non-uniform shape. The wire 40 may comprise more than one cable, or be double-coiled, as is known in the art. A variety of heating wire configurations may be obtained in uncoiled and pre-coiled form from several manufacturers.

The resistance wire 40, before coiling, has a uniform heat output per unit actual length 50 at given voltage and temperature conditions. The number of coil turns per unit length, the diameter of the coil 41 itself, and the outer sheath diameter are varied to obtain a specified watt density (e.g. watts/square inch external sheath surface) in each portion of the element 30. For most water heater applications, the design watt density typically varies from about 40 to about 220 watts per square inch. The heat output per unit sheath length 52 of element 30 will vary with the actual length of the resistance wire 40 within the particular portion of the element. As shown, the number of coil turns within unit sheath length 51 is less than the number of coil turns in unit sheath length 52, reducing the watt density in length 51.

As shown in FIG. 3, the coil 41 of resistance wire 40 is expanded or stretched at the return bend areas, as illustrated at return bend 34. The coil 41 of resistance wire 40 may also be linearly expanded in areas approaching the full radius portions of the return bends 32, 34 and 36, illustrated at element transition portion 58. At the bend areas 32, 34, and 36, rapid scaling otherwise results in reduced heat transfer to the water, and overheating of the element 30. The degree of scaling in limited transition areas, e.g. portion 58 between the bend and an adjacent straight portion, e.g. portion 60 is, without a reduction in heat output, intermediate the scaling at the bend and the straight portion. Thus, in accordance with this invention, the heat output per unit central length 53 at the bend(s) or in areas adjacent the bend(s) is reduced without reducing the heat output in the non-critical straight sections, e.g. section 60. In this discussion, unit lengths 50, 51, 52 and 53 of sheath 42 are equivalent.

Because of the ubiquitous presence of hardness in water, scaling can rarely be entirely avoided. However, reducing the heat output in the bend areas and areas adjacent thereto reduces the scaling to a tolerable level, i.e. approximately equal to that of the straight sections, to increase the overall net heat transfer, balance the degree of scaling and greatly extend the life of the element. The ratio of resistance wire length (i.e. a first value) in a given unit sheath length in any particular area to the resistance wire length (i.e. a second value) per unit sheath length in the most densely coiled (i.e. least uncoiled) portion in the sheath 42, is denoted herein as the expansion ratio. Typically, the most densely coiled portion is in a straight portion of the sheath 42. As illustrated in FIG. 3, the expansion ratio of the sheath 42 may be about 0.2–0.4 for some applications. However, the minimum expansion ratio may vary from about 0.1 to about 0.9, depending upon the element size and shape, the required thermal output per unit length of element 30, the water hardness, the coil construction and the desired element life. More normally, the expansion ratio is in the general range of about 0.2–0.8. In general, the critical factors related to size and shape of an elongate sheathed element 30 are the diameter of the sheath 42, and the return bend radius 54. The two factors determine the intra-element separation distance 56 which affects the operating time before significant scale bridging of the bend area occurs.

As depicted in FIG. 3, the expansion or stretching ratio may be continuously varied between a minimum and maximum value to achieve the desired thermal output at each portion of the element 30. For example, within the area adjoining a bend, e.g. portion 58, a minimum ratio at the bend may be continuously varied upward to 1.0 where portion 58 adjoins straight portion 60. An expansion ratio of 1.0 indicates equivalency to the coiled resistance wire 40 in the non-critical straight portions 60 of the sheath 42.

Another way of expressing the configuration of the resistance wire 40 is by the term coil density, e.g. the number of coil turns per unit length of sheath 42. The total length of wire 40 within a given length of sheath 42 may not be a strict linear function of the number of coil turns, however, because of the variation in overall coil diameter as the wire 40 is stretched. In this invention, the coil density in bend areas is typically about 0.1–0.9 that of the straight areas of the sheath 42. More normally, the coil density in the bend areas is about 0.2–0.8 that of the straight portions of the sheath 42.

For example, a commercial resistance heating wire 40 has a round cross-section of 0.02 inch diameter. The wire 40 is to be used in a heating element 30 at a maximum watt density of 109 watts per square inch of sheath exterior surface. As commercially available, wire 40 is tightly coiled to an outer coil diameter of 0.125 inches and the heating wire coil 41 contains about 120 complete turns containing about 4.05 lineal feet of resistance wire 40 per foot of sheath length. As fully coiled, the resistance wire 40 provides 1301 watts per hour per foot of length. The coil 41 may be fully stretched or expanded to produce a straight wire, and the thermal energy provided per foot of such a heating element during heating operations is about 0.25 that of the element portion containing the fully coiled wire 40. Any intermediate thermal energy value is easily achieved by intermediate partial expansion or stretching of the coil 41 of resistance wire 40 to the desired degree. It is often desirable to continuously vary the expansion ratio over portions of the heating element 30 to compensate for varied tendencies to scale, in order to achieve a generally uniform degree of scaling and avoid bridging of the scale as long as possible.

FIG. 4 shows one side of an exemplary "wave" type water heater element 70 of the invention. This "wave" element is similar to the element 30 of FIG. 2, but has a sheath 74 with multiple bends. The element 70 comprises a multi-bend sheath 74 with mount 72 having means for sealing attachment to the water heater wall, such means shown as screw threads 73. Alternative attachment means may be used on the mount 72, as known in the art.

The "wave" type element 70 is shown with first connecting portion 76, first bend portion 78, second bend portion 80, first intermediate straight portion 82, third bend portion 84, fourth bend portion 86, first return bend 88, fifth bend portion 90, sixth bend portion 92, second intermediate straight portion 94, seventh bend portion 96, eighth bend portion 98, and second return bend 100.

The radii of curvature of some of the portions of the sheath 74 are denoted by the following indicia and the degree of coil expansion is generally illustrated in the corresponding figures as follows:

| Portion of Sheath | Radius Indicia | Shown in FIG.: |
|---|---|---|
| First connecting portion 76 | (Infinity) | FIG. 4A |
| First bend portion 78 | 102 | FIG. 4B |
| Second bend portion 80 | 104 | FIG. 4C |
| First interm. straight 82 | (Infinity) | FIG. 4D |
| Third bend portion 84 | 106 | FIG. 4E |
| Fourth bend portion 86 | 108 | |
| First return bend 88 | 110 | FIG. 4F |
| Fifth bend portion 90 | 112 | FIG. 4G |
| Sixth bend portion 92 | 114 | |
| Second interm. straight 94 | (Infinity) | |
| Seventh bend portion 96 | 116 | |
| Eighth bend portion 98 | 118 | |

In the figures, the degree of coil expansion is somewhat exaggerated to clearly illustrate the invention.

Typically, the radii of curvature of the return bends are approximately equal. Thus, the radius of return bend 100 will normally be approximately equal to the radius of return bend 88. A second half of the sheath 70 is hidden in FIG. 4, lying behind and being a mirror image of the visible first half of the sheath 74, having a proximate end joined to the first half of sheath 74 at second return bend 100, and having a distal end joined to mount 72.

As shown in FIG. 4A, the first connecting portion 76 includes an elongate hollow sheath 74 through which a coil 121 of resistance wire 120 is passed. In the straight connecting portion, the coil 121 is shown connected at joint 126 to a low resistance member 124 e.g. a cold pin, joined to one of two terminals 68. The low resistance member 124 and/or terminal 68 to which it is connected pass(es) through the mount 72, being electrically sealed from it. The coil 121 is shown in the densest configuration to achieve the greatest watt density, and placement of the low resistance member 124 near the mount 72 prevents overheating of the mount and adjacent wall. The resistance of member 124 may actually have an intermediate value lower than the high resistance wire 120, to provide a more gradual temperature change and lower the stress at the ends of the sheath 74. The space between the coil 121 and the sheath 74 is filled with an electrically insulating, heat conducting material 122.

In the exemplary heating element 70 of FIG. 4, the coil 121 is maintained at maximum density, i.e. minimum expansion, in straight portions 82, 94 of the element.

The bend portions 78, 80, 84, 88 and 90 are shown in FIGS. 4B, 4C, 4E, 4F and 4G, respectively. The coil 121 of resistance wire 120 is expanded approximately in accordance with the following equation such that the heat output decreases as the bend radius decreases:

$$L_2/L_1=(R_2/R_1)^s,$$

where s is a scaling factor equal to 0.15 to 0.75, $R_1$ is the radius of curvature of a first bend A, $R_2$ is the radius of curvature of a second bend B, $L_1$ is the heating wire length per unit sheath length in first bend A, and $L_2$ is the heating wire length per unit sheath length in second bend B.

The equation is generally valid when the radii of curvature are between about 1.5 and 10 inches. At radii greater than about 10–12 inches, the scaling propensity approaches that of a straight element portion, depending, of course on the actual spacing between opposing element portions.

The invention is generally useful when the separation distance 56 between different portions of the element 30 is less than about 2 inches. In order to minimize the size of entry ports, domestic electric water heaters commonly have a heating element or elements 30 with a separation distance 56 of about 0.5 to 1.0 inch, or less, and the use of this invention in such heaters is very advantageous.

The invention encompasses the use of cold pins or wires of differing watt outputs as part of the resistance wire 40, 120. Lower resistance portions of wire may be preformed at specific locations in the coil 41, 121 to result in the desired heat output in each portion of the element 10, 70. The resistance heating wire 120 to be installed in the sheath may be preformed of two or more coiled wires having differing unit heat output, i.e. watt density, to achieve the desired heat output at each bend portion and straight portion of the element. Both the unit heat output and length of resistance wire may be controlled in each portion of the sheath.

Thus, for example, an electrical heating element may be formed with a first bend A having a radius of curvature $R_1$ and containing a first heating wire portion of length $L_1$ having a heat output $H_1$ per unit length. The element also contains a second bend B having a radius of curvature $R_2$ and containing a heating wire portion of length $L_2$ having a heat output $H_2$ per unit length. The heating wire length $L_1$, $L_2$ per unit sheath length for said bend A and said bend B, respectively are related by:

$$(L_2 \times H_2)/(L_1 \times H1) = (R_2)/R_1)^s,$$

where s is a scaling factor equal to 0.15 to 0.75. In most instances, the scaling factor s is between 0.25 and 0.65. It is seen that L×H equals the total heat output per unit length of sheath. In the foregoing discussion, L represents the length of uncoiled wire, rather than the overall coil length.

The equation is generally applicable when the radii of curvature are between about 1.5 and 10 inches.

As already shown, the heat output is also reduced in the same manner in the sheath area where it is joined to the mount 72, because the mount 72 otherwise effectively acts as a "bend" to produce added scaling.

Construction of the heater element in accordance with the foregoing results in a. a more uniform degree of scaling, b. less total scaling, c. a longer time between required element cleaning, and d. a longer element life.

It is anticipated that various changes and modifications may be made in the construction, arrangement, operation and method of construction of the electrical heating element disclosed herein without departing from the spirit and scope of the invention as defined in the following claims.

What is claimed is:

1. An electrical heating element for a water heater, comprising:

an elongate sheath of a heating element, said sheath having first and second ends and a bend portion and non-bend portions between said ends;

a helically coiled resistance heating wire having first and second ends, said wire enclosed within said sheath and extending between said first and second ends of said sheath;

means for connecting said first and second ends of said heating wire to an external electrical source for generating heat; and the length of heating wire per unit length of sheath in the bend portion comprises a first value, the length of heating wire per unit length of sheath in a non-bend portion comprises a second value, and the first value being substantially less than the second value.

2. The electrical heating element of claim 1, wherein said ratio of the first value to the second value is between about 0.1 and about 0.9.

3. The electrical heating element of claim 1, wherein the ratio of the first value to the second value is between about 0.2 and about 0.8.

4. The electrical heating element of claim 1, wherein said second value is variable.

5. The heating element of claim 1, wherein said non-bend portions of said sheath comprise generally parallel straight portions joined by a bend portion.

6. The heating element of claim 1, wherein said sheath includes a first straight portion joined to a second straight portion by a first bend portion, a third straight portion joined to a fourth straight portion by a second bend portion, and a third bend portion joining said second and fourth straight portions, said first through fourth straight portions being generally parallel.

7. The heating element of claim 1, further comprising an electrically insulating, heat conducting material surrounding said heating wire within said sheath.

8. The heating element of claim 1, wherein said first and second ends of said element are proximate each other and are sealably joined to an element wall mount.

9. An electrical water heater, comprising:

a generally cylindrical pressure vessel having a wall with a sealable port;

an electrical heating element assembly having an elongate element and an element mount sealably attached to said element, said mount positioned within said port to seal said port, whereby said element comprises:

an elongate sheath of a heating element, said sheath having first and second ends and a bend portion and non-bend portions between said ends;

a helically coiled resistance heating wire having first and second ends, said wire enclosed within said sheath and extending between said first and second ends of said sheath;

means connected to said first and second ends of said sheath for sealably inserting said heating element through the wall of a water heater into the interior thereof; and means for connecting said first and second ends of said heating wire to an external electrical source for generating heat;

whereby the length of heating wire per unit length of sheath in the bend portion comprises a first value, the length of heating wire per unit length of sheath in a non-bend portion comprises a second value, and the ratio of said first value to said second value is about 0.1–0.9.

10. The electrical water heater of claim 9, wherein the ratio of said first value to said second value is about 0.2–0.8.

11. A resistance heating wire for an electrical heating element having straight portions, at least one bend portion and two ends proximate each other and joined to an element mount, comprising:

a continuously coiled heating wire preformed to provide a high density of coil turns in straight portions of a heating element and a lower density of coil turns in a bend portion of the heating element, wherein the density of coil turns in said bend portion is 0.1–0.9 that in the straight portions.

12. The resistance heating wire of claim 11, wherein the density of coil turns in said bend portion is 0.2–0.8 that in the straight portions.

13. An electrical heating element for a water heater, comprising:

an elongate sheath of a heating element, said sheath having first and second ends and at least two bend portions between said ends, said at least two bend portions differing in radii of curvature;

a helically coiled resistance heating wire having first and second ends, said wire enclosed within said sheath and extending generally between said first and second ends of said sheath;

means for connecting said first and second ends of said heating wire to an external electrical source for generating heat; and the heating wire is preconfigured by selective stretching along spaced apart sections of its length prior to being enclosed within the sheath and is positioned within the sheath to provide a lesser length of heating wire per unit length of sheath in the bend portion where the radius of curvature is lesser.

14. The electrical heating element of claim 13, wherein the sheath has a first bend A having a radius of curvature $R_1$ and a second bend B having a radius of curvature $R_2$, wherein the heating wire length $L_1$, $L_2$ per unit sheath length for said bend A and said bend B, respectively are related by:

$$L_2/L_1=(R_2/R_1)^2,$$

where s is a scaling factor equal to 0.05 to 0.75.

15. The electrical heating element of claim 14, wherein the scaling factor is equal to a number between 0.1 and 0.65.

16. The electrical heating element of claim 15, wherein the scaling factor is equal to a number between 0.15 and 0.6.

17. An electrical heating element for a water heater, comprising:

an elongate sheath of a heating element, said sheath having first and second ends and at least two bend portions between said ends, said at least two bend portions differing in radii of curvature;

a resistance heating wire having first and second ends, said wire enclosed within said sheath and extending generally between said first and second ends of said sheath;

means for connecting said first and second ends of said heating wire to an external electrical source for generating heat; and the resistance heating wire being constructed and preconfigured prior to being enclosed within the sheath to comprise length portions of lower and high heat outputs per unit length, said portions of wire having lower heat output per unit length being within said bend portions of lower radius of curvature and said portions of wire having higher heat output per unit length being within said bend portions of higher radius of curvature.

18. The electrical heating element of claim 17, wherein the sheath has a first bend A having a radius of curvature $R_1$ and contains a heating wire portion of length $L_1$ having a heat output $H_1$ per unit length, said sheath containing a second bend B having a radius of curvature $R_2$ and containing a heating wire portion of length $L_2$ having a heat output $H_2$ per unit length, wherein the heating wire length $L_1$, $L_2$ per unit sheath length for said bend A and said bend B, respectively are related by:

$$(L_2\times H_2)/(L_1\times H_1)=(R_2/R_1)^s,$$

where s is a scaling factor equal to 0.05 to 0.75.

19. The electrical heating element of claim 18, wherein the scaling factor is equal to a number between 0.1 and 0.65.

20. The electrical heating element of claim 19, wherein the scaling factor is equal to a number between 0.15 and 0.6.

* * * * *